United States Patent [19]

Steinbock

[11] Patent Number: 4,941,786

[45] Date of Patent: Jul. 17, 1990

[54] EXCAVATOR

[76] Inventor: Heinz Steinbock, Industriestrasse 30+32, 6718 Grunstadt, Fed. Rep. of Germany

[21] Appl. No.: 315,934

[22] Filed: Feb. 27, 1989

[30] Foreign Application Priority Data

Apr. 8, 1988 [DE] Fed. Rep. of Germany ... 8804637[U]

[51] Int. Cl.[5] ..... B66C 9/00

[52] U.S. Cl. ..... 414/695.7; 37/103; 414/667; 414/671; 172/667

[58] Field of Search ..... 414/695, 695.7, 667, 414/671; 37/103; 172/667, 663

[56] References Cited

U.S. PATENT DOCUMENTS

| | | | |
|---|---|---|---|
| 3,252,604 | 5/1966 | Wiemann et al. | 414/695 |
| 3,436,099 | 4/1969 | Long | 37/103 |
| 4,003,484 | 1/1977 | Jones et al. | 414/694 |
| 4,470,750 | 9/1984 | Vockinger | 414/667 X |
| 4,808,061 | 2/1989 | Cook et al. | 414/695.7 |

FOREIGN PATENT DOCUMENTS

| | | | |
|---|---|---|---|
| 1067614 | 5/1967 | United Kingdom | 414/695 |

OTHER PUBLICATIONS

Construction Plant and Equipment, "Why We Became No. 1" (JCB advertisement), Apr. 1977.

*Primary Examiner*—Randolph A. Reese
*Assistant Examiner*—Arlen L. Olsen
*Attorney, Agent, or Firm*—Kinzer, Plyer, Dorn, McEachran & Jambor

[57] ABSTRACT

An excavator has a frame attached to its rear side for mounting of an implement. The frame includes lateral limit vertical beams which are connected by upper and lower horizontal rails. The rails are separated vertically. A slide member has guide grooves which engage the top surface of the upper rail and bottom surface of the lower rail to slidably mount the slide member on the frame. A toothed rack is attached to the underside of the upper rail and is disposed behind the front surface of the rail. A drive motor attached to the slide has a pinion meshing with the toothed rack. Actuation of the motor causes the slide member to slide on the rails.

1 Claim, 3 Drawing Sheets

EXCAVATOR

BACKGROUND OF THE INVENTION

The invention relates to an excavator having mounted implements attached to the rear side thereof. The implements, such as a bucket, grab and drilling, milling or hoeing devices and the like, are provided with a slide and a mounting plate having lateral limit vertical beams which are connected by means of separated horizontal rails provided at the rear of the excavator, the slide being guided on the rails.

In particular so-called excavator loaders are built in which the most varied mounted implements can be attached to both the front and rear side, such as a shovel on the front side and a bucket grab on the rear side. In this case, the bucket or grab is mounted on the slide via a slewing block having a boom and an arm and the slide can be displaced from side to side across the rear width of the excavator. In order to effect the displacement, lateral support legs on the vertical beam are extended and the boom swivelled laterally with the bucket being set down on the ground. The slide is displaced by extending the boom and the arm.

This type of displacement involves considerable disadvantages. In order to effect a displacement of the slide possible at all, a resistance is required in the area of the bucket in order that the reaction can be used to displace the slide. However, it is often not possible to find suitable resistance such as when the excavator is used for operating in urban areas. This is also the case when other implements than a bucket or shovel are attached, such as, a grab or a drilling device, since it is not possible here to support the boom and the arm on the implement. This also applies if displacement of the slide is to be effected without mounted implements. A large radius of action is required for this type of displacement, since the boom together with the arm has to be swivelled to the slide and the two parts then have to be extended for performing the movement. Furthermore, it is necessary to repeatedly move the main boom and the arm in order to perform the movement, since the slide tilts very frequently, and thus involves a considerable amount of time and accurate localised adjustment of the slide is scarcely possible.

SUMMARY OF THE INVENTION

The object of the invention is to design an excavator of the aforementioned type mentioned in such a way that the slide can be moved without the requirement to use the mounted implements.

In accordance with the present invention, there is provided an excavator having provision for an implement to be attached to the rear side thereof, the implement being provided with a slide and there being provided on the rear side of the excavator a mounting plate having lateral limit vertical beams which are connected by means of horizontal rails which are separated from one another and on which the slide is guided; a toothed rack running parallel to the rails is arranged between the vertical beams, and a drive motor having a pinion meshing with the toothed rack is attached to the slide.

The object is achieved by the provision of a toothed rack running parallel to the rails arranged between the vertical beams, a drive motor having a pinion meshing with the toothed rack being attached to the slide.

The drive motor is advantageously a hydraulic motor.

Furthermore, it is preferred that the toothed rack is arranged on the lower edge of the upper rail.

The invention has the advantage that the slide can be moved without the use of special auxiliary means such as resistance to movement of an implement so that the excavator can be used without problem for operating in urban areas. Thus the slide can be displaced into any desired position when using any type of mounted implement.

BRIEF DESCRIPTION OF THE DRAWINGS

The invention is described in greater detail below with reference to an exemplary embodiment shown in the drawings, in which.

DETAILED DESCRIPTION OF THE INVENTION

Figure 1:
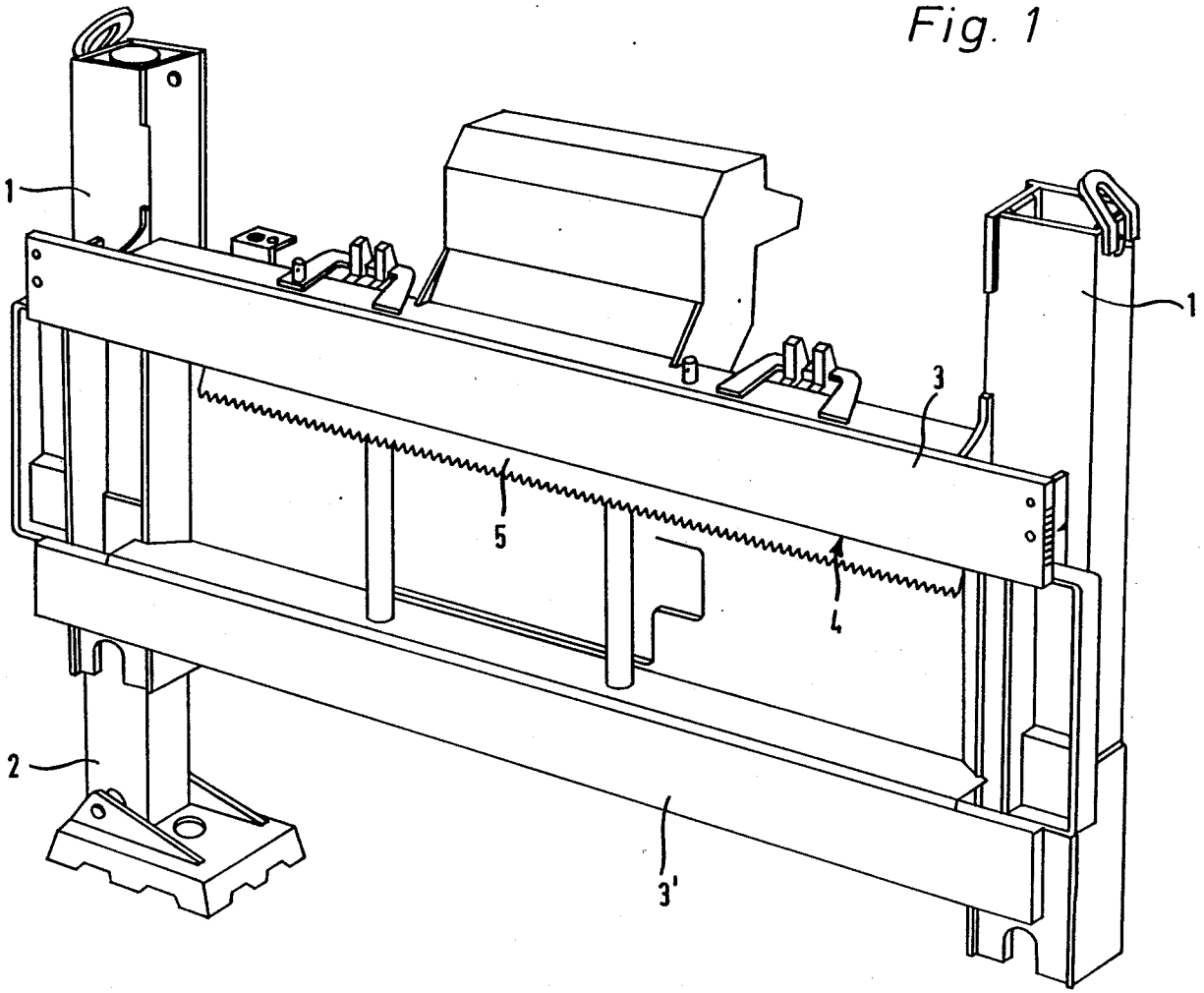
FIG. 1 shows in a diagrammatic view the mounting plate to be attached to the rear side of the vehicle or excavator.

The mounting plate shown in FIG. 1 has two lateral vertical beams 1 in which supporting legs 2 are arranged so as to be raisable and lowerable. Two horizontal rails 3, 3' run between the vertical beams 1, the rails 3, 3' being arranged at a distance from one another. Attached to the lower edge 4 of the upper rail 3 is a toothed rack 5 which essentially extends over the entire length of the rail and defines the displacement path of the slide.

Figure 2:
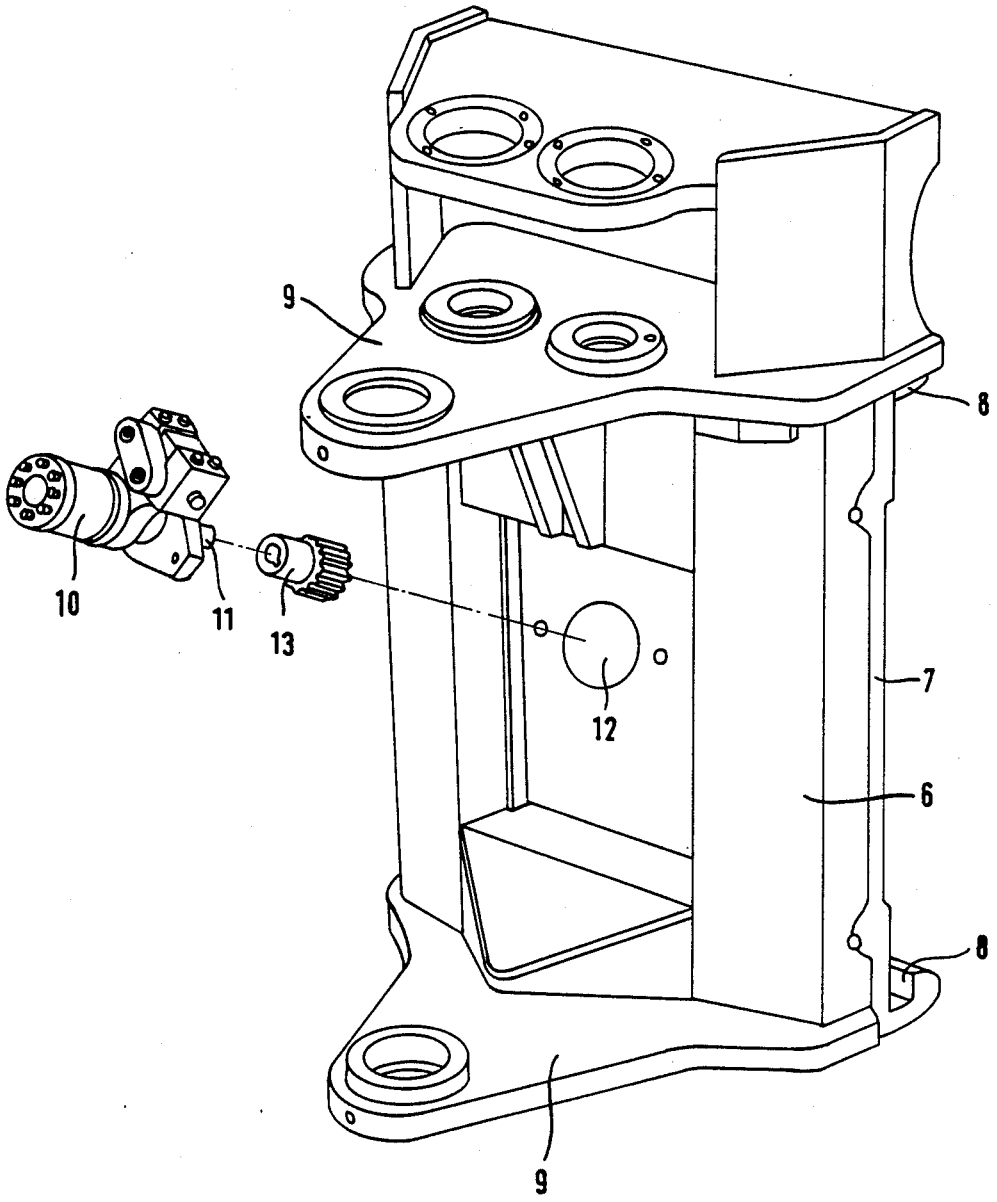
FIG. 2 shows in a diagrammatic view the slide on which the implement is arranged.
Figure 3:
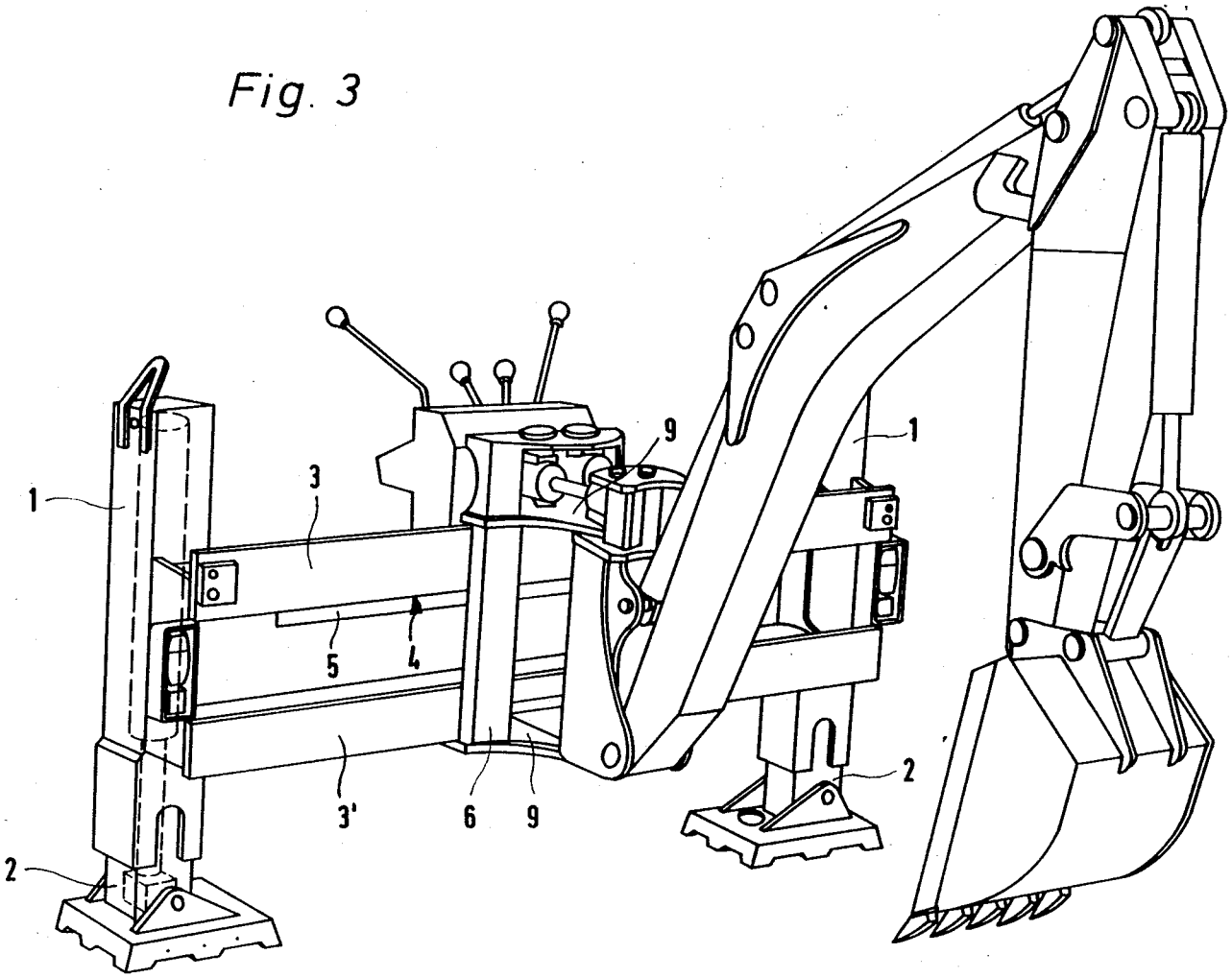
FIG. 3 shows a perspective view of a slide and mounting plate having an implement mounted thereon.

A slide 6 (FIG. 2) is arranged on the rails 3, 3', the side facing the rails 3, 3' having a plate 7. Guide grooves are provided on the under side or on the upper side of the plate 7 by which the slide 6 is attached to the rails 3, 3'. Furthermore, the slide 6 has articulation parts 9, to which the boom and the various slewing cylinders are fixed. Fixed to the back of the plate 7 is a hydraulic motor 10 whose drive shaft 11 extends through an opening 12 in the plate 7. A pinion 13 is fixed on this shaft 11 which meshes with the toothed rack 5. The hydraulic motor 10 is connected via an additional control circuit to the hydraulic system of the excavator. As soon as the slide has been moved to the desired position by the motor 10 it is locked by a conventional mechanical or hydraulic locking device.

I claim:

1. An excavator including a frame for slidable attachment of an implement thereto, the frame comprising a pair of lateral limit vertical beams, upper and lower horizontal rails connected to the vertical beams, the rails being separated from one another and each rail defining top, bottom, front and rear surface, the frame having but a single toothed rack with that rack attached to the bottom surface of the upper horizontal rail and disposed entirely behind the front surface of the upper rail, the rack running parallel to the rails between the vertical beams, a slide member having a plate mounted adjacent the front surfaces of the horizontal rails by an upper guide groove engageably enclosing the top surface of the upper rail and a lower guide groove engageably enclosing the bottom surface of the lower rail such that the slide is mounted for horizontal sliding movement on the rails, the slide including means for mounting an implement thereto, and a drive motor attached to the slide and having a pinion meshing with the toothed rack such that actuation of the motor causes sliding movement of the slide on the rails.

* * * * *